United States Patent [19]

Mugrauer

[11] 4,358,196

[45] Nov. 9, 1982

[54] DEVICE FOR THE EXCHANGE OF A DEVELOPER MEDIUM FOUND IN A DEVELOPER STATION

[75] Inventor: Hubert Mugrauer, Poering, Fed. Rep. of Germany

[73] Assignee: Siemens Aktiengesellschaft, Berlin & Munich, Fed. Rep. of Germany

[21] Appl. No.: 267,663

[22] Filed: May 27, 1981

[30] Foreign Application Priority Data

Jul. 2, 1980 [DE] Fed. Rep. of Germany ..... 3025103

[51] Int. Cl.[3] ..... G03G 15/10; B05C 11/00

[52] U.S. Cl. ..... 355/10; 355/14 D; 430/399

[58] Field of Search ..... 355/10, 14 D, 94; 118/659, 429; 430/398, 399; 432/60

[56] References Cited

U.S. PATENT DOCUMENTS

| | | | |
|---|---|---|---|
| 3,331,592 | 7/1967 | Cassano et al. | 263/6 |
| 3,991,709 | 11/1976 | Sato et al. | 355/10 X |
| 4,110,029 | 8/1978 | Goshima et al. | 355/10 |
| 4,166,702 | 9/1979 | Okamoto et al. | 355/10 X |
| 4,168,329 | 9/1979 | Miyakawa et al. | 355/10 X |
| 4,179,210 | 12/1979 | Bestenreiner et al. | 355/10 |

*Primary Examiner*—A. C. Prescott

*Attorney, Agent, or Firm*—Hill, Van Santen, Steadman, Chiara & Simpson

[57] ABSTRACT

For the development of charge images on photoelectric carriers, a developer mixture is used which is comprised of carrier particles and toner particles. In order to prevent excessive aging of this developer mixture, the developer station is constantly supplied with fresh developer and used developer is constantly removed in the same quantity. The quantity of the developer which is supplied to or removed from the developer station is determined with the help of dosing devices. These can include a rotary element with a bore hole. The bore hole is filled with developer and, after rotation of the element by 180°, it is again emptied. The rotational speed of the rotary element and the size of the bore hole determine the quantity of developer which is supplied to the developer station or, respectively, is removed therefrom.

7 Claims, 3 Drawing Figures

FIG 1
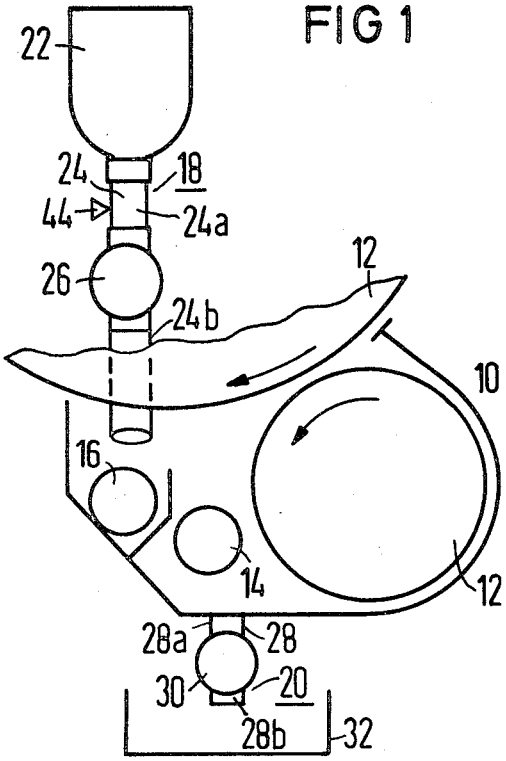
FIG 2
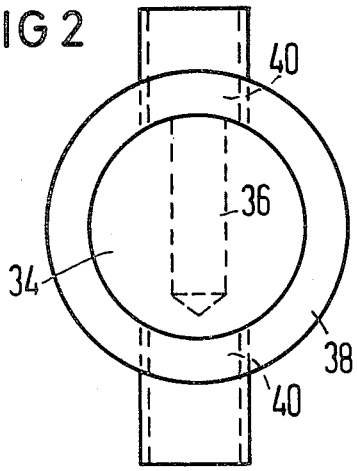
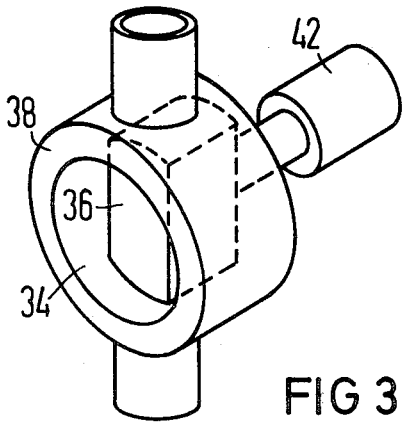
FIG 3

DEVICE FOR THE EXCHANGE OF A DEVELOPER MEDIUM FOUND IN A DEVELOPER STATION

BACKGROUND OF THE INVENTION

The invention concerns a device for the exchange of a developer mixture found in a developer station which is used for the development of charge images applied on an intermediate carrier in the case of printing or copying devices.

Printing and copying devices which operate according to the electrostatic principle are known (see, for example, U.S. Pat. No. 3,331,592, incorporated herein by reference). In the case of these devices, charge images of the characters to be printed are generated on an intermediate carrier, for example, a drum with an electrophotographic layer. The charge carriers following this proceed to a developer station in which the charge images are developed and thus are made visible. For the development, a developer mixture is used which contains toner particles which are attracted by the charge images to the intermediate carrier. Following this, the developed charge images are transferred to a recording medium, for example a paper web, and are fixed there.

For the development of the charge images, mainly a two-component developer is employed. A serious disadvantage of this technology is the dropoff of the print quality arising by means of the aging of the developer mixture during the service life of the developer. In order to avoid too strong a dropoff of the print quality, previously the entire developer was exchanged at specific maintenance intervals. However, it could not be prevented that during operation, the printing quality continuously dropped off from a certain initial value.

SUMMARY OF THE INVENTION

An object of the invention is to provide a device with the help of which a uniformly good printing quality can be attained. This problem is solved in the case of a device of the type described above by providing two dosing devices of which the one constantly feeds fresh developer to the developer station, and wherein the other constantly removes used developer from the developer station in the same quantity.

The dosing device can, in a simple manner, be comprised of a rotary element arranged in a tube. At least one bore hole is arranged in the rotary element. In the one part of the tube subdivided by the rotary element, there is developer mixture which is to be fed to the developer station. Always when the bore hole of the rotary element lies under the one portion of the tube, developer can flow from the one portion of the tube into the bore hole, and from there can proceed into the other part of the tube. From the other part of the tube, the developer is transported to the developer station. The quantity of fresh toner flowing to the developer station is determined by means of the size of the bore hole and the rotational speed of the rotary element. The dosing device with whose help developer mixture is removed from the developer station is constructed in a corresponding manner.

It is preferable that the bore hole does not go through the rotary element of the dosing device. Then the rotary element is arranged in an outer element whereby, between the rotary element and the outer element, only a very small clearance exists. In the outer body, there are arranged two openings lying opposite one another. One is connected with the one portion of the tube and the other with the other portion of the tube. The quantity of developer which can proceed from the one portion of the tube to the other portion of the tube is here also determined by the size of the bore hole and the speed of rotation of the rotary element.

The structure of the device is particularly simple when the reservoir for fresh toner, the tube, the dosing device, and the developer station are arranged one under the other. Thus, for supplying fresh developer to the developer station, gravity is utilized. Correspondingly, for removal of used toner from the developer station, the developer station, the tube, and the dosing device can be arranged one under the other. Below the tube a receiving vessel is provided for receiving the used developer.

In order to determine whether there is fresh developer in the reservoir, a sensor can be arranged in the one portion of the tube which determines whether developer is present in the tube.

With the help of the inventive device, in the developer station a developer mixture is present having a constant average service life. Accordingly, printing quality always remains uniformly good. All problems with developers which arise in the last fourth of the service life of the developer are eliminated. Among these are, in particular: soiling or contamination of the devices by high toner concentration, increasing quantity of developer and developer transport problems associated therewith in the developer station, as well as carrier or support discharge which can lead to defects of the printed image. Further, the toner concentration can be kept constant in the developer mixture and does not need to be adjusted in accordance with the aging. The bothersome exchange of the entire developer, and the down times associated therewith are eliminated since the exchange of the reservoir as well as the collecting container or receptacle can take place during the printing operation. The exchange of the reservoir as well as the catcher container can take place in the same intervals as was done previously with the complete emptying. The whole developer station can be significantly reduced in size because the large quantities of developer necessary for acceptable maintenance intervals are eliminated.

BRIEF DESCRIPTION OF THE DRAWINGS

FIG. 1 shows the structure of the device and its position with respect to the developer station;

FIG. 2 shows an embodiment of the dosing device; and

FIG. 3 shows a perspective view of the dosing device.

DESCRIPTION OF THE PREFERRED EMBODIMENTS

The principal structure of a known developer station is seen in FIG. 1. The developer station designated 10 lies next to an intermediate carrier 12 designed as a drum with a photoelectric surface. In the developer station 10, there is a developer roller 9 which, according to the magnetic brush principle, transports developer from the developer station to the intermediate carrier 12. Developer rollers of that sort or magnetic brushes are known. Next to the developer roller 9 there are arranged two rollers 14 and 16 embodied as mixing rollers. Their function consists in constantly mixing the developer mixture. The structure of the mixing rollers 14, 16 is unimportant for the device of the invention.

Above the developer station 10, and specifically above one of the mixing rollers, for example roller 16, there is a device arranged with whose help the developer station 10 can be supplied with constantly fresh toner in set quantities. This device is designated 18. Correspondingly, below the developer station 10 there is arranged a further device 20 with whose help used developer can be removed from the developer station 10 in set quantities.

The one device 18 contains a reservoir 22 in which there is fresh developer. The reservoir 22 is connected with a tube 24 subdivided into two portions by means of a dosing device 26. The one portion 24*a* of the tube 24 lies between the reservoir 22 and the dosing device 26, and the other portion 24*b* of the tube 24 lies between the dosing device 26 and the developer station 10. The reservoir 22, the tube 24, and the dosing device 26 in the example are arranged one under the other so that the supplying of fresh developer to the developer station 10 can proceed with the help of gravity.

In the case of a filled reservoir 22, the developer flows from the reservoir 22 to a portion 24*a* of the tube 24. The dosing device 26 determines the quantity of developer which can proceed from the one portion 24*a* of the tube 24 to the other portion 24*b* of the tube 24, and thus into the developer station 10. A possible structure of the dosing device is depicted in FIG. 2 and FIG. 3.

The device 20 arranged under the developer station 10, and with which used developer is removed from the developer station, is comprised of a tube 28 and a dosing device 30. The dosing device 30 subdivides the tube 28 into a portion 28*a* and into another portion 28*b*. The portion 28*a* of the tube 28 is connected with the developer station 10, and the other portion 28*b* of the tube 28 leads to a collecting container or receptacle 32. Also in the case of this device, for flowing of the developer, gravity is utilized; for this reason, the developer station 10, the tube 28, the dosing device 30, and the collecting container 32 are arranged one under the other. The dosing device 30 again determines the quantity of the used developer removed from the developer station 10.

If by means of the dosing device 26, in a given unit of time the same quantity of fresh toner is supplied to the developer station 10 and, by means of the dosing device 30, in this same unit of time the same quantity of used toner is removed from the developer station 10, then in the developer station there is a developer mixture with a constant average service life. Accordingly, advantages result which were mentioned above.

A possible structure of the dosing device 26, 30 results from FIGS. 2 and 3. These figures contain a rotary element 34 in which there is a bore hole 36. The bore hole 36 can receive a specific volume of developer when it is located directly under the one portion of the tube 24 or, respective, 28. The rotary element 34 is, for example, rotated with a set small rotational speed by means of a small synchronous motor. In dependence upon the size of the bore hole and the speed of rotation of the rotary element 34, a quantity of the developer can be determined which flows through the dosing device 26 or, respectively 30.

The quantity of developer which can flow through the dosing device can be determined particularly precisely if the bore hole 36 does not entirely pass through the rotary element 34. This embodiment form is depicted in FIG. 2. Then the rotary element 34 lies in an outer element 38. which is stationary. The clearance between rotary element 34 and outer element 38 should be very slight so that the carrier particles cannot proceed into the bearing gap. The quantity of the developer which flows through the dosing device is here determined by means of the volume of the bore hole 36 and the speed of rotation of the rotary element 34. It is thus possible to transport defined small quantities of developer through the dosing device. The outer element 38 is provided with two openings 40 and 40*a* which lie opposite one another. The one opening, for example 40, is connected with the one portion of the tube, and the other opening, for example 40*a*, is connected with the other portion of the tube. The openings 40, 40*a* are necessary in order to make possible the flow of the developer to the bore hole 36 or, respectively, the flow out of the developer from the bore hole 36.

FIG. 3 shows in a perspective view once again the structure of the dosing device. The rotary element 34 and the outer body 38 are shown. Furthermore, a motor 42 is depicted which is connected with the rotary element 34. Within the rotary element 34, the bore hole 38 is arranged with whose help the developer quantities are transported from one portion of the tube to the other portion of the tube.

If the rotary element 34 with its bore hole 36 is located in the position depicted in FIG. 2 when the bore hole 36 is filled with developer. After a rotation of 180°, the received, precisely dosed quantity of developer is emptied downward. After attainment of the 360° position of the rotary element, the process begins again. Thus, the dosing quantity and the frequency can be determined via the size of the bore hole as well as the speed of rotation of the rotary element.

In order to determine whether there is still fresh developer contained in the reservoir 22, a sensor 44 can be arranged in the one portion 24*a* of the tube 24. The sensor 44 determines whether there is still developer contained in the one portion 24*a* of the tube 24. If this is not the case, then the reservoir 22 is empty and must be filled up again. Since there is still a piece of tube lying between the sensor 44 and the dosing device 26, in the case of an indication of the sensor, there is still a small reserve of developer present which suffices for the exchange of the developer in the developer station 10 until the operator has again filled the reservoir 22.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A developer exchange device located in a developer station of a printing or copying device, the developer being used for the development of charge images applied on an intermediate carrier, comprising: first and second dosing device means, the first of which constantly supplies fresh developer to the developer station and the second of which constantly removes used developer from the developer station in substantially the same quantity such that developer in the developer station has a substantially constant average service life.

2. A device according to claim 1 wherein the dosing device means each comprise a rotary element arranged in a tube so as to subdivide the tube, and in the rotary element there is arranged at least one bore hole means for receiving developer.

3. A device according to claim 2 wherein the bore hole means does not pass through the rotary element, the rotary element is arranged in an outer element, a clearance between the rotary element and the outer element being sufficiently small to prevent leakage, and in the outer element there are arranged two openings lying opposite one another, one of which is connected with one portion of the tube and the other with another portion of the tube.

4. A device according to claim 2 wherein a reservoir for receiving fresh developer is provided, and a first portion of the tube above the rotary element, the first dosing device means, a second portion of the tube beneath the rotary element, and the developer station lie one under the other.

5. A device according to claim 2 wherein a first portion of the tube above the rotary element, the second dosing device means, a second portion of the tube below the rotary element, and a collecting receptacle all lie one under the other beneath the developer station.

6. A device according to claim 4 wherein a sensor means is arranged in the first portion of the tube at the first dosing device means by means of which it is determined whether developer is present in the tube first portion.

7. A developer exchange device for exchanging a developer mixture located in a developer station of a printing or copying device, comprising: a supply reservoir; a first tube leading from the reservoir to the developer station; a second tube leading from the developer station to a collecting receptacle; a first dosing device means in the first tube for transferring at spaced intervals a given quantity of developer mixture stored in the reservoir to the developer station; and a second dosing device means in the second tube for transferring out from the developer station the same quantity of developer fluid within the same time intervals as the first dosing device means to the collecting receptacle.

* * * * *